US011624484B2

(12) United States Patent
Butler et al.

(10) Patent No.: US 11,624,484 B2
(45) Date of Patent: Apr. 11, 2023

(54) FLASHLIGHT HAVING A REMOVABLE LIGHT HEAD

(71) Applicant: MILWAUKEE ELECTRIC TOOL CORPORATION, Brookfield, WI (US)

(72) Inventors: Daniel P. Butler, Wauwatosa, WI (US); Kevin R. Kirk, Minnetonka, MN (US); Jeffrey L. Spenner, Germantown, WI (US); Kevin D. White, Milwaukee, WI (US)

(73) Assignee: MILWAUKEE ELECTRIC TOOL CORPORATION, Brookfield, WI (US)

( * ) Notice: Subject to any disclaimer, the term of this patent is extended or adjusted under 35 U.S.C. 154(b) by 0 days.

(21) Appl. No.: 17/569,250

(22) Filed: Jan. 5, 2022

(65) Prior Publication Data

US 2022/0214017 A1 Jul. 7, 2022

Related U.S. Application Data

(60) Provisional application No. 63/133,820, filed on Jan. 5, 2021.

(51) Int. Cl.
*F21L 4/00* (2006.01)
*F21V 14/06* (2006.01)
(Continued)

(52) U.S. Cl.
CPC ..... *F21L 4/005* (2013.01); *F21V 14/065* (2013.01); *F21V 17/002* (2013.01); *F21V 17/14* (2013.01); *F21V 31/005* (2013.01)

(58) Field of Classification Search
CPC ... F21L 4/00; F21L 4/005; F21L 4/022; F21L 4/04; F21L 4/045; F21V 17/002;
(Continued)

(56) References Cited

U.S. PATENT DOCUMENTS 1,958,796 A 5/1934 Alexander
2,361,480 A 10/1944 Joffo
(Continued)

FOREIGN PATENT DOCUMENTS

CN 201787347 U 4/2011
CN 202532197 U 11/2012
(Continued)

OTHER PUBLICATIONS

International Search Report and Written Opinion for Application No. PCT/US2022/011305 dated Apr. 29, 2022 (10 pages).

*Primary Examiner* — Y M. Quach Lee
(74) *Attorney, Agent, or Firm* — Michael Best & Friedrich LLP

(57) ABSTRACT

A flashlight includes a main body, a power source supported within the main body, a first electrical contact supported by the main body and electrically connected to the power source, and a head removably coupled to the main body. The head includes a light source, a lens, and a sliding focus mechanism axially moveable to adjust a distance between the light source and the lens. The flashlight further includes a second electrical contact supported by the head and electrically connected to the light source, a main body bayonet portion supporting the first electrical contact, and a head bayonet portion supporting the second electrical contact and engaged with the main body bayonet portion to electrically connect the first electrical contact with the second electrical contact.

21 Claims, 7 Drawing Sheets

(51) Int. Cl.
*F21V 31/00* (2006.01)
*F21V 17/00* (2006.01)
*F21V 17/14* (2006.01)

(58) Field of Classification Search
CPC ..... F21V 17/14; F21V 17/02; F21V 14/065; F21V 31/005
See application file for complete search history.

(56) References Cited

U.S. PATENT DOCUMENTS

| | | | | |
|---|---|---|---|---|
| 4,821,156 | A | 4/1989 | Siefert et al. | |
| 4,888,670 | A | 12/1989 | Sharrah | |
| 5,592,749 | A * | 1/1997 | Trimmer | A45D 20/14 219/541 |
| 5,765,937 | A | 6/1998 | Shiau | |
| 6,027,226 | A | 2/2000 | Shiau | |
| 6,547,414 | B2 | 4/2003 | Steger | |
| 6,598,993 | B1 | 7/2003 | Dalton et al. | |
| 6,773,139 | B2 | 8/2004 | Sommers | |
| 6,866,401 | B2 | 3/2005 | Sommers et al. | |
| 6,957,905 | B1 | 10/2005 | Pritchard et al. | |
| 7,083,298 | B2 | 8/2006 | Pritchard et al. | |
| 7,246,927 | B2 | 7/2007 | Wikle et al. | |
| 7,360,920 | B2 | 4/2008 | Dalton et al. | |
| 7,461,945 | B2 | 12/2008 | Shiau | |
| 7,530,706 | B2 | 5/2009 | Ouyang et al. | |
| 7,771,077 | B2 | 8/2010 | Miller | |
| 7,775,686 | B2 | 8/2010 | Dalton et al. | |
| 8,152,327 | B2 | 4/2012 | Brands et al. | |
| 8,297,756 | B2 | 10/2012 | Ouyang et al. | |
| 8,371,710 | B2 | 2/2013 | Gupta et al. | |
| 8,444,290 | B2 | 5/2013 | Opolka | |
| 8,573,796 | B2 | 11/2013 | Opolka | |
| 8,746,920 | B2 | 6/2014 | Chen | |
| 9,140,417 | B2 | 9/2015 | Chen | |
| 9,279,570 | B2 | 3/2016 | Lin et al. | |
| 9,416,938 | B2 | 8/2016 | Windom | |
| 10,605,417 | B2 | 3/2020 | Windom et al. | |
| 10,605,418 | B2 | 3/2020 | Chen et al. | |
| 2007/0177382 | A1 | 8/2007 | Pritchard et al. | |
| 2011/0063823 | A1 | 3/2011 | Qiu | |
| 2012/0020062 | A1 * | 1/2012 | Opolka | F21V 14/065 362/187 |
| 2018/0335199 | A1 | 11/2018 | Simms | |

FOREIGN PATENT DOCUMENTS

| | | | |
|---|---|---|---|
| CN | 203010219 | U | 6/2013 |
| CN | 203115513 | U | 8/2013 |
| CN | 203115514 | U | 8/2013 |
| CN | 205606473 | U | 9/2016 |
| CN | 207687745 | U | 8/2018 |
| CN | 208025178 | U | 10/2018 |
| CN | 208919757 | U | 5/2019 |
| CN | 209856826 | U | 12/2019 |
| CN | 109668064 | B | 8/2020 |
| CN | 211232463 | U | 8/2020 |
| DE | 202020103024 | U1 | 6/2020 |
| EP | 3489573 | B1 | 8/2020 |
| KR | 1020060114923 | A | 11/2006 |
| KR | 101572607 | B1 | 11/2015 |

* cited by examiner

FLASHLIGHT HAVING A REMOVABLE LIGHT HEAD

CROSS-REFERENCE TO RELATED APPLICATIONS

This application claims priority to U.S. Provisional Patent Application No. 63/133,820 filed Jan. 5, 2021, the entire contents of which are incorporated herein by reference.

FIELD

The present disclosure relates to a lighting apparatus, such as a flashlight. More particularly, the present disclosure relates to a flashlight with a removable light head.

BACKGROUND

Typical flashlight heads house at least one bulb or LED. Generally, the bulb/LED is irremovably attached to a power source, which is often stored in a main body or handle part of the flashlight.

SUMMARY

In one embodiment, the invention provides a flashlight including a main body, a power source supported within the main body, a light head removably coupled to the main body. The light head includes a light source selectively powered by the power source, a lens, and a sliding focus mechanism that is linearly slidable along an axial direction to adjust a distance between the light source and the lens. The light source is electrically connected with the power source while the light head is coupled to the main body.

In another embodiment, the invention provides a flashlight including a main body including a main body connection portion and an end cap, a power source supported within the main body between the end cap and the main body connection portion, a first electrical contact supported in the main body connection portion and electrically connected to the power source, a light head including a light source and a light head connection portion, and a second electrical contact supported in the light head connection portion and electrically connected to the light source. The light head is rotatable and axially slidable along an axial direction relative to the main body to selectively remove the light head from the main body and electrically disconnect the power source from the light source.

In yet another embodiment, the invention provides a flashlight including a main body, a power source supported within the main body, a first electrical contact supported by the main body and electrically connected to the power source, a head removably coupled to the main body, the head including a light source, a lens, and a sliding focus mechanism axially moveable to adjust a distance between the light source and the lens, a second electrical contact supported by the head and electrically connected to the light source, a main body bayonet portion supporting the first electrical contact, and a head bayonet portion supporting the second electrical contact and engaged with the main body bayonet portion to electrically connect the first electrical contact with the second electrical contact.

Other aspects of the disclosure will become apparent by consideration of the detailed description and accompanying drawings.

Before any embodiments of the disclosure are explained in detail, it is to be understood that the disclosure is not limited in its application to the details of construction and the arrangement of components set forth in the following description or illustrated in the following drawings. The disclosure is capable of other embodiments and of being practiced or of being carried out in various ways. Also, it is to be understood that the phraseology and terminology used herein is for the purpose of description and should not be regarded as limiting.

Use of "including" and "comprising" and variations thereof as used herein is meant to encompass the items listed thereafter and equivalents thereof as well as additional items. Use of "consisting of" and variations thereof as used herein is meant to encompass only the items listed thereafter and equivalents thereof. Unless specified or limited otherwise, the terms "mounted," "connected," "supported," and "coupled" and variations thereof are used broadly and encompass both direct and indirect mountings, connections, supports, and couplings.

DETAILED DESCRIPTION

Figure 1:
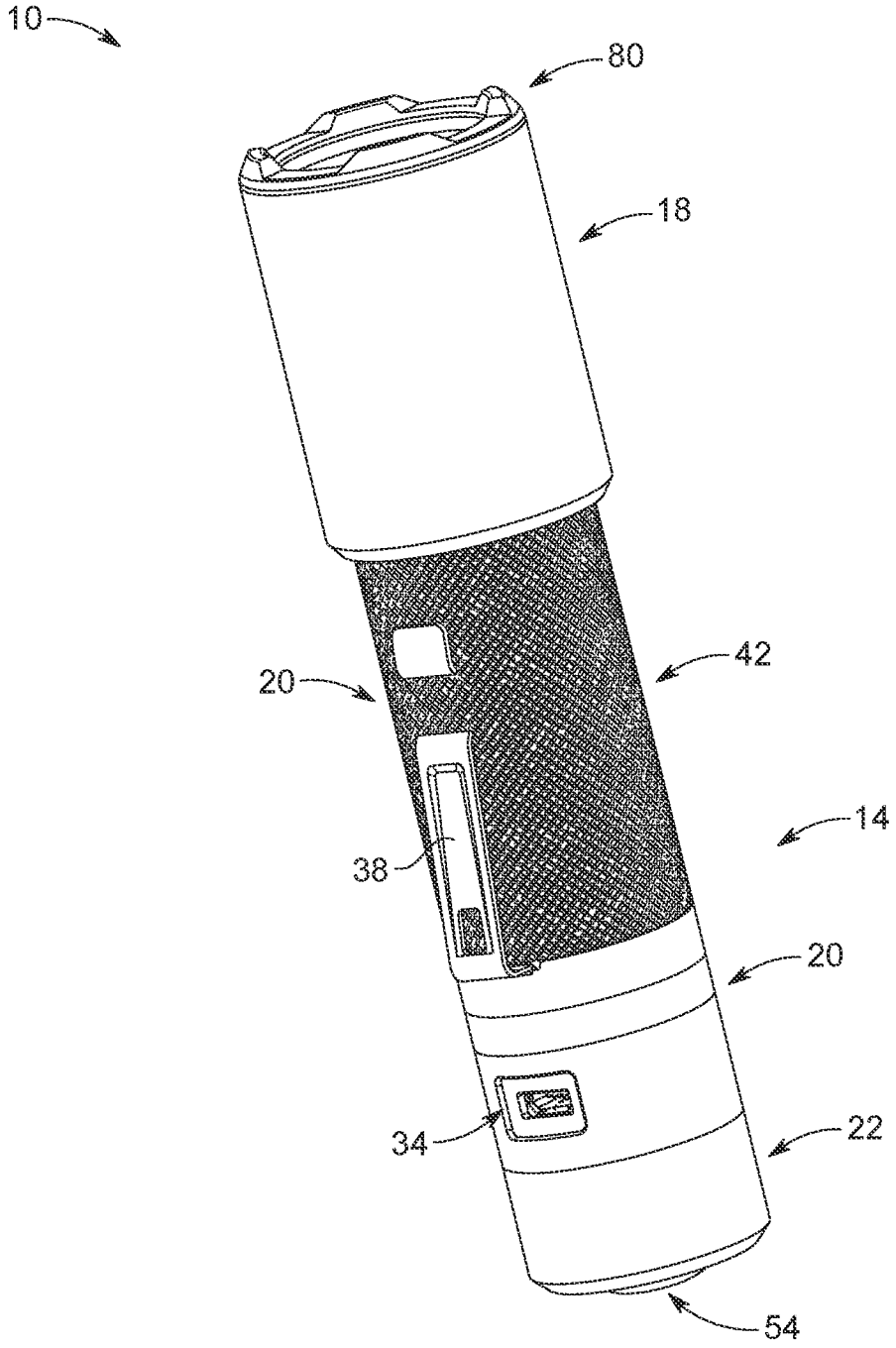
FIG. 1 is a perspective view of a flashlight.
Figure 2A:
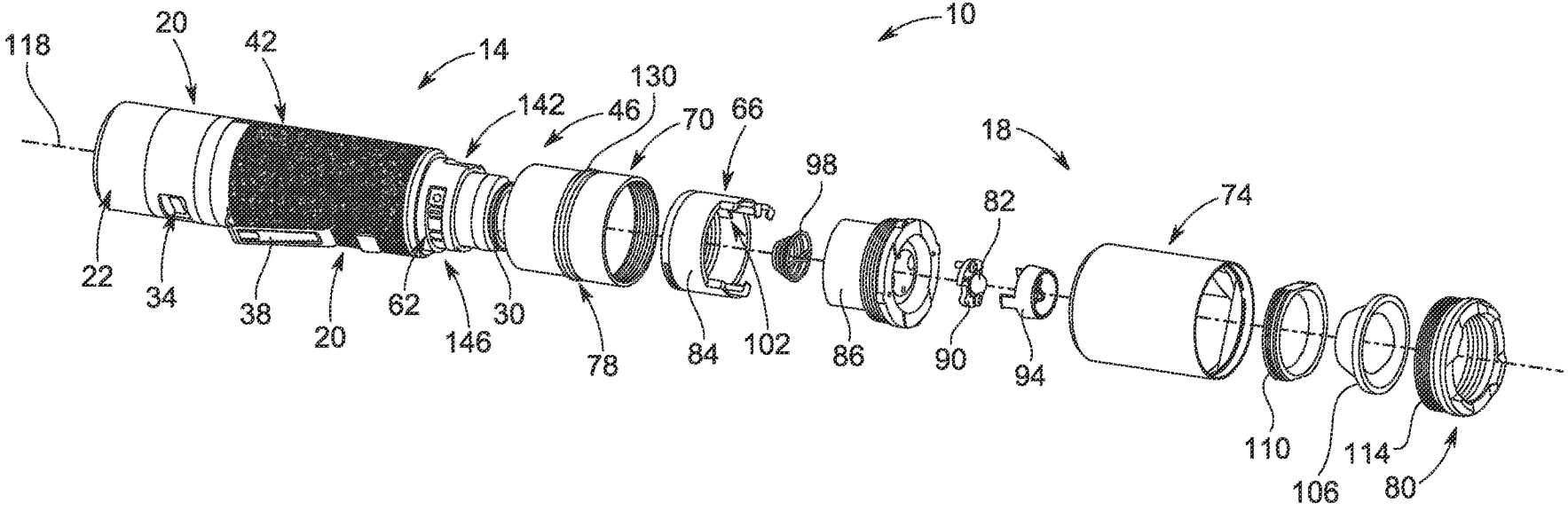
FIG. 2A is an exploded view of the flashlight of FIG. 1.
Figure 2B:
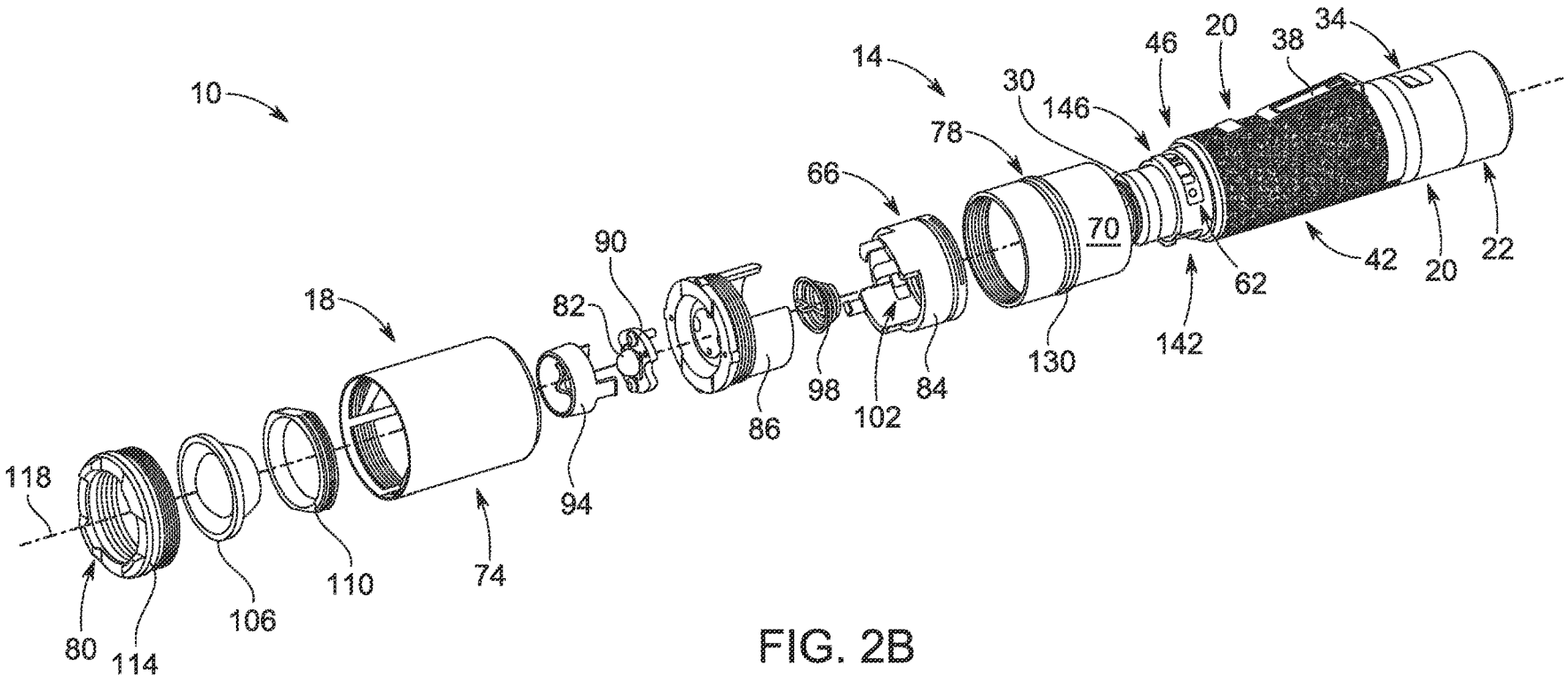
FIG. 2B is another exploded view flashlight of FIG. 1.

As shown in FIGS. 1-2B, a flashlight 10 includes a main body 14 and a light head 18 selectively attachable to the main body 14. The main body 14 is configured to be grasped by a user and may also be referred to as a handle. The main body 14 includes a housing 20, an end cap 22 coupled to a first end of the housing 20, one or more circuit boards 26 (e.g., main control board (MCB), power control board (PCB), encoder board/chip, etc.) (FIG. 3A) positioned within the housing 20, and a power source 30 positioned within the housing 20. In the illustrated embodiment, the power source 30 is a removable/rechargeable battery 30. The illustrated main body 14 also includes a battery charging receptacle 34 and a clip 38 supported by the housing 20. The housing 20 defines a grip 42, such as a knurled or otherwise contoured surface. In the illustrated embodiment, the main body 14 further includes a main body portion 46 to selectively couple the light head 18 to the main body 14.

Figure 3A:
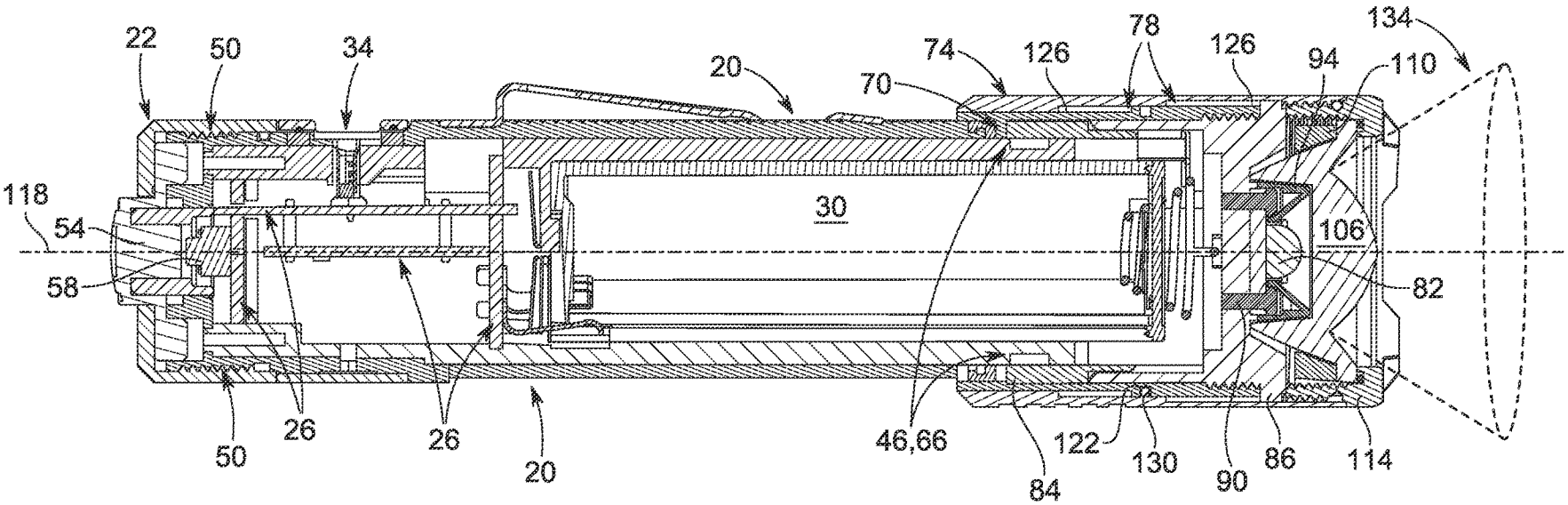
FIG. 3A is a cross-sectional view of the flashlight taken along line 3-3 of FIG. 1 to show a sliding focus mechanism in a first position.
Figure 3B:
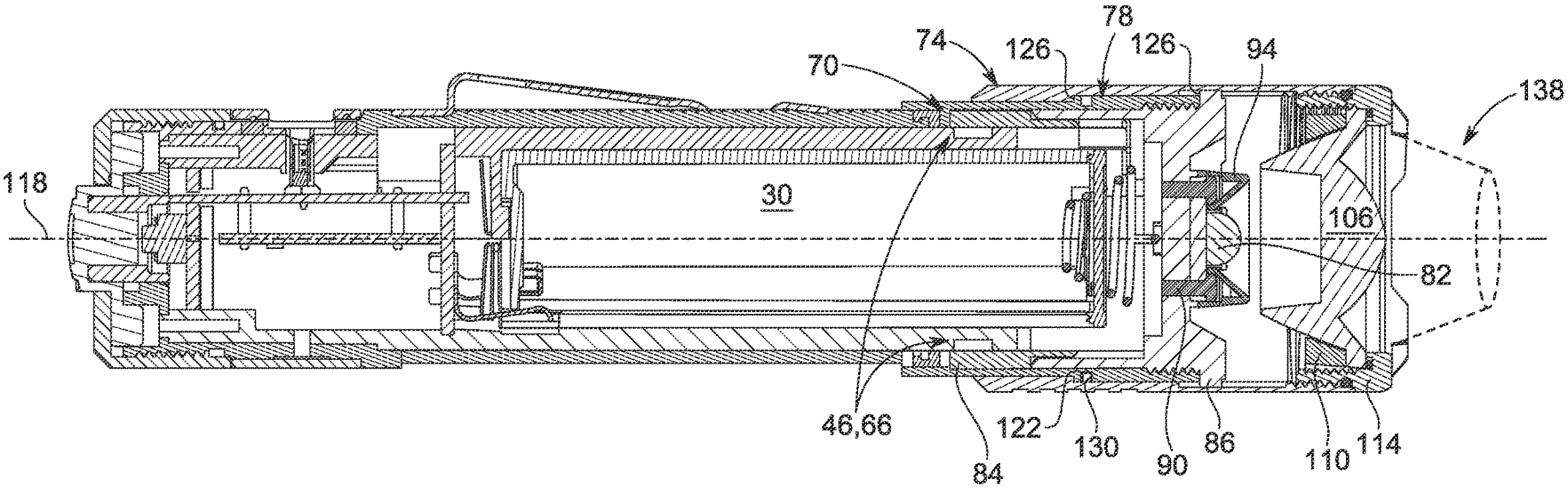
FIG. 3B is a cross-sectional view of the flashlight taken along line 3-3 of FIG. 1 to show the sliding focus mechanism in a second position.

With reference to FIGS. 2A-3B, the end cap 22 is attached to the main body 14 via a threaded connection 50 between the end cap 22 and the main body 14. In other embodiments, the end cap 22 may be attached to the main body 14 by another attachment mechanisms such as a fastener. In yet another embodiment, the end cap 22 may be integrally formed on the main body 14. As best shown in FIGS. 3A and 3B, the end cap 22 supports a physical switch 54. In the illustrated embodiment, the switch 54 is a push-button. In other embodiments, the switch 54 could alternatively be a pressure pad, a rotatable selector switch, a toggle, a slider, or the like. In some embodiments, the switch 54 may be located elsewhere on the main body 14 or may be located on the light head 18.

The switch 54 is moveable (e.g., depressible) by a user to control operation of the flashlight 10 (e.g., ON/OFF). In some embodiments, the switch 54 may also control a mode (e.g., high, medium, low, flashing, etc.) of the flashlight 10. A switch contact 58 is supported within the main body 14 adjacent the switch 54. The switch contact 58 is in electrical communication with at least one of the circuit boards 26. The switch contact 58 is configured to read a condition of the switch 54 and communicate the read condition to one of the boards 26. Although the switch 54 and the circuit boards 26 are adjacent one another in the illustrated embodiment, the switch 54 and the circuit boards 26 could be positioned in different locations on or in the flashlight 10, main body 14, and/or end cap 22.

The circuit boards 26 are also utilized to control charging of the battery 30 through the battery charging receptacle 34. The battery charging receptacle 34 may be configured to receive a connector (e.g., USB, micro USB, USB-C, etc.) suitable for supplying power to the battery 30, which in turn supplies power to the flashlight 10. In other embodiments, the battery 30 is a removable and disposable battery 30. In general, electrical components (e.g., the switch contact 58, the charging receptacle 34, etc.) supported on or in the main body 14 are always in electrical communication with the boards 26 and battery 30. The battery 30 also supplies power to electrical contacts 62 of the main body connection portion 46.

With continued reference to FIGS. 2A-3A, the light head 18 includes a head connection portion 66, a base 70, a focusing head 74, and a sliding mechanism 78. The illustrated light head 18 may also include one or more projections 80 that extend from the light head 18. As will be described in greater detail below with reference to FIGS. 4A and 4B, the main body connection portion 46 and head connection portion 66 are complementary to one another and are configured to selectively electrically and mechanically connect the light head 18 to the main body 14.

Figure 4A:
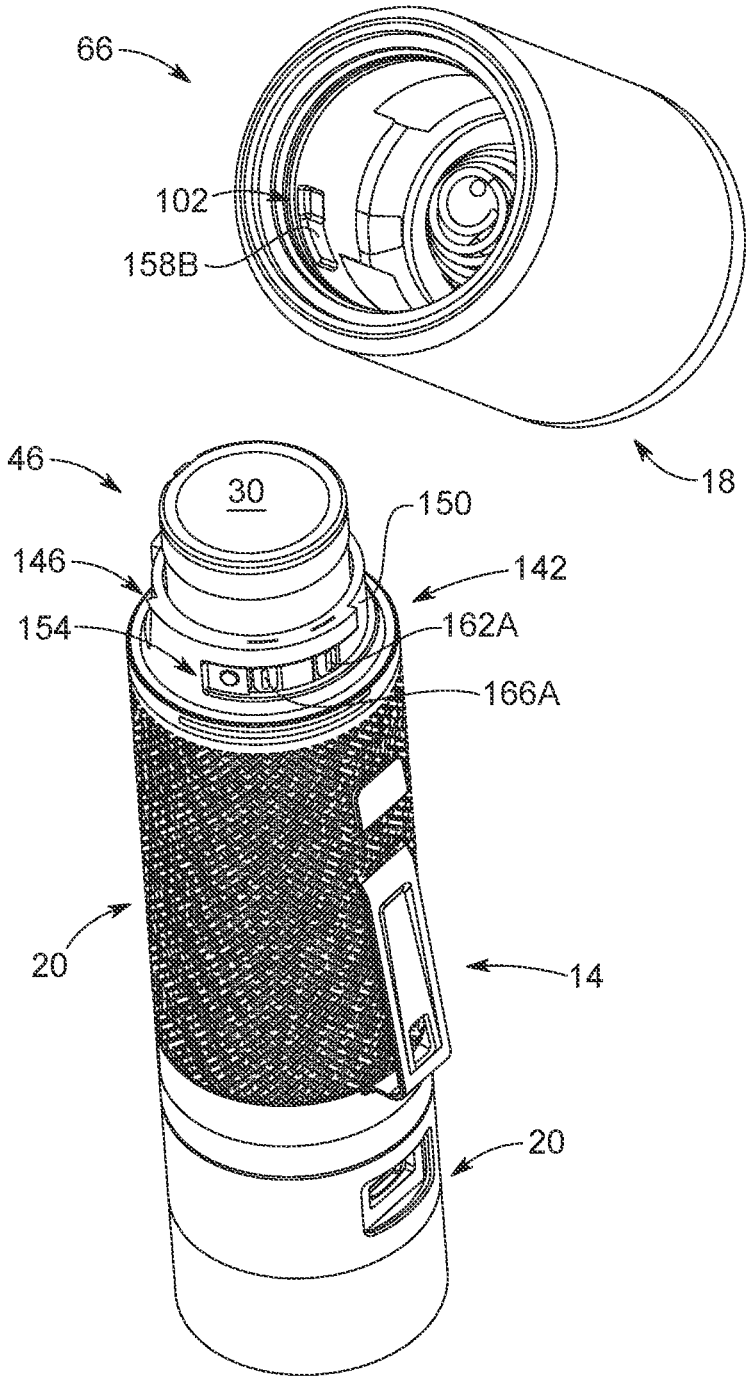
FIG. 4A is a perspective view of the flashlight of FIG. 1 with a light head removed to show a connection portion.
Figure 4B:
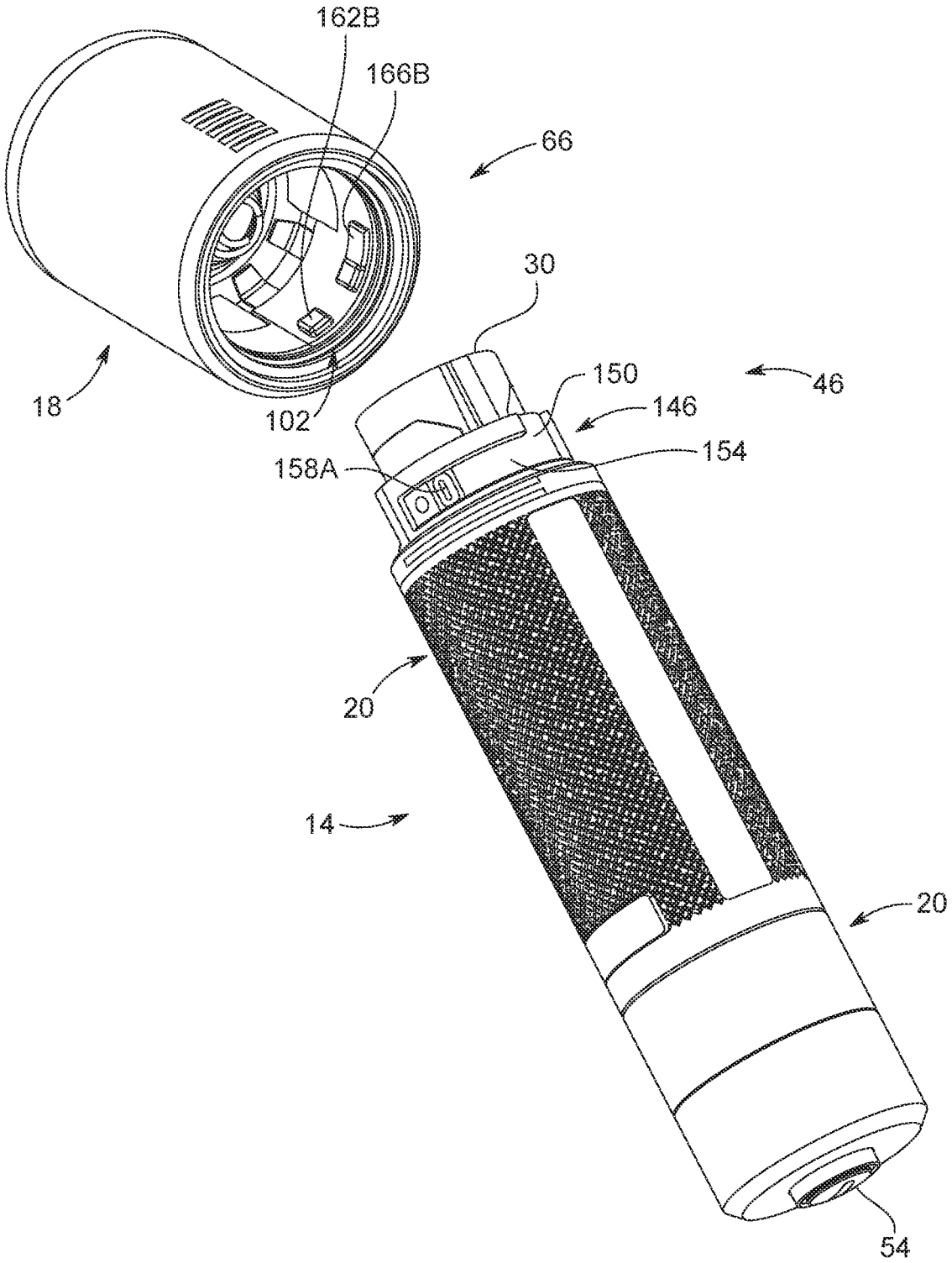
FIG. 4B is another perspective view of the flashlight of FIG. 1 with the light head removed to show the connection portion.

With specific reference to FIGS. 2A and 2B, the light head 18 houses a light source 82 supported within the base 70 on a support 90 and configured to generate light. In the illustrated embodiment, the light source 82 is a light emitting diode (LED). In some embodiments, the light source 82 may include an array of LEDs. In other embodiments, the light head 18 may include other suitable light sources. In the illustrated embodiment, the base 70 further includes a conductive substrate 84 and an insert 86. The substrate 84 and insert 86 are fastened within the base 70. In other embodiments, either or both of the substrate 84 and the insert 86 may be formed on the base 70. The base 70 further supports a reflector cup or bowl 94 surrounding the light source 82, a retainer 98, and electrical contacts 102 positioned within the head connection portion 66 (FIGS. 4A and 4B). The retainer 98, which may be referred to as a spring retainer or a spring, is positioned on the base 70 and asserts a spring force onto the battery 30 while the light head 18 and the main body 14 are connected together. In other embodiments, the spring 98 could be positioned on the main body 14, directly supported on the battery 30, bearing against the battery 30, or disposed on another part of the flashlight 10 in order to maintain a tight fit between the light head 18 and the main housing 14 when connected. In still other embodiments, the spring 98 could be a rigid member for maintaining a tight fit between the connected light head 18 and the main housing 14.

The focusing head 74 includes a lens 106 supported in the focusing head 74 by a lens mount 110 and a lens retainer 114. The lens mount 110 is threaded into the focusing head 74 on one end of the lens 106. The lens retainer 114 is threaded into the focusing head 74 on another end of the lens 106, opposite the lens mount 110, such that the lens 106 is retained within the focusing head 74 between the mount 110 and the retainer 114. The arrangement of the mount 110 and the retainer 114 eliminates the need to form threads directly on the lens 106. In another embodiment, the lens 106 may be formed on the focusing head 74 or even over molded within the focusing head 74. The projections 80 may be formed on or attached to the focusing head 74 to protect the lens 106. Heat generated during operation of the flashlight 10 may also be dissipated into the projections 80 to reduce an operating temperature within the flashlight 10.

Referring now to FIGS. 3A and 3B, the focusing head 74 is moveable relative to the base 70 via the sliding mechanism 78 to alter a distance between the LED 82 and the lens 106. In the illustrated embodiment, the focusing head 74 linearly slides in an axial direction 118 that is parallel to a longitudinal axis of the flashlight 10. The sliding mechanism 78 includes a groove 122 formed in the base 70 and stops 126 formed on the focusing head 74 and the base 70. The groove 122 is configured to receive a gasket 130 (e.g., an O-ring, an X-ring, etc.) positioned between the focusing head 74 and the base 70. In the illustrated embodiment, the gasket 130 is positioned in the groove 122 formed on an outer surface of the base 70. In another embodiment, the groove 122 is formed on an inner surface of the focusing head 74.

The gasket 130 applies resistance between the focusing head 74 and the base 70 to resist movement between the focusing head 74 and the base 70. Enough resistance is applied by the gasket 130 to allow a user to move (e.g., linearly slide) the focusing head 74 to a desired position. The focusing head 74 and the base 70 are shaped such that the stops 126 limit the movement of the focusing head 74 relative to the base 70. The stops 126 allow the focusing head 74 to be moved between a first position (FIG. 3A) and second position (FIG. 3B).

In the first position, the focusing head 74 is at a minimum limit, and light emitted by the light source 82 shines through the lens 106 with a relatively wide pattern 134. In the second position, the focusing head 74 is at a maximum limit, and light emitted by the light source 82 shines through the lens 106 with a relatively narrow or spotlight pattern 138. Stated another way, an area of light emitted by the light source 82 narrows as the lens 106 is moved away from the light source 82. While the stops 126 inhibit the focusing head 74 from moving beyond the maximum and minimum limit, the gasket 130 allows the focusing head 74 to moved smoothly between the limits.

Referring now to FIGS. 4A and 4B, the complementary main body and head connection portions 46, 66 will be described in greater detail. The illustrated connection portions 46, 66 form a bayonet-style connection between the main body 14 and the light head 18. As such, the main body connection portion 46 may be referred to as a main body bayonet portion 46, and the head connection portion 66 may be referred to as a head bayonet portion 66. The connection portions 46, 66 allow the light head 18 to be disconnected and physically separated from the main body 14 without tools or otherwise disassembling the flashlight 10. Separating the light head 18 from the main body 14 allows a user to access and remove or replace the battery 30 such that battery 30 may be accessible in the main body 14 while the light head 18 is separated from the main body 14.

The illustrated main body connection portion 46 includes a first bayonet channel 142 and a second bayonet channel 146. Each of the first and second bayonet channels 142, 146 have a linear groove 150 and a radial groove 154 continuous with the linear groove 150. The linear groove 150 is an axial groove that that extends in the axial direction 118, while the radial groove 154 extends radially around a portion of the handle housing 14. The radial groove 154 supports the electrical contacts 62, which may consist of a first positive terminal 158A (e.g., LED+), a first negative terminal 162A (e.g., LED−), and a first auxiliary terminal 166A (e.g., ground, negative-temperature-coefficient thermistor, etc.).

The illustrated head connection portion 66 includes the electrical contacts 102, which consist of a second positive terminal 158B (e.g., LED+), a second negative terminal 162B (e.g., LED−), and a second auxiliary terminal 166B (e.g., ground, negative-temperature-coefficient thermistor, etc.). In the illustrated embodiment, the head connection portion 66 and the terminals 158B, 162B, 166B are supported on the substrate 84. The illustrated terminals 158B, 162B, 166B are conductor pads that project radially inward from the substrate 84. The substrate 84 is configured to electrically connect the terminals 158B, 162B, 166B to the light source 82. In other embodiments, the head connection portion 66 and terminals 158B, 162B, 166B may be provided on another part of the base 70.

As illustrated in the FIGS. 4A and 4B, the second positive terminal 158B is arranged to be received in one of the first and second bayonet channels 142, 146, while the second negative terminal 162B is arranged to be received in the other of the first and second bayonet channels 142, 146. In other embodiments, the second positive terminal 158B, the second negative terminal 162B, and the second auxiliary terminal 166B may be arranged in the same channel. In yet another embodiment, the terminals 158B, 162B, 166B may be arranged in any arraignment or combination within the channels 142, 146.

The electrical contacts 102 are configured to be physically received in the bayonet channels 142, 146 and to electrically interface with the electrical contacts 62. More specially, the electrical contacts 102 are initially received in the linear groove 150 and do not make electrical connection with the electrical contacts 62. Following adequate axial movement, the electrical contacts 102 are moved radially within the radial groove 154 into electrical connection with the electrical contacts 62. Concurrently, the electrical contacts 102 are moved into mechanical connection with the electrical contacts 62 through a snap fit. Stated another way, the electrical contacts 102 may be moved over the electrical contacts 62 by overcoming (e.g., temporarily overcoming) an outward biasing or snapping force to retain the LED head 18 on the handle housing 14.

As described above, the battery 30 supplies power to the electrical contacts 62 within the main body connection portion 46. When the light head 18, or another electrically powered device or head, is sufficiently moved axially and radially to be attached to the main body 14, electrical contacts 102 on the light head 18 are moved into contact with the electrical contacts 62 on the main body 14 to complete an electrical circuit from the battery 30, thereby powering the light head 18. For example, a power circuit between the battery 30, the electrical contacts 62 on the main body 14, the electrical contacts 102 on the light head 18, and the light source 82 is completed after sufficient axial and radial movement of the light head 18 relative the main body 14.

Described another way, the flashlight 10 includes the main body 14, the light head 18, and a bayonet mount mechanism including complimentary male and female parts (i.e., bayonet portions 46, 66). Either of the male and female portions include conductors (i.e., contacts 62 and pads 102) configured to electrically interface with one another to selectively power the light head 18 and mechanically couple the main body 14 and the light head 18 to one another. In the illustrated embodiment, the light head 18 includes the male bayonet portion in the form of the head connection portion 66 and the electrical contacts 102, while the main body 14 includes the female bayonet portion in the form of the main body connection portion 46, the channels 142, 146, and the electrical contacts 62. In other embodiments, the male and female portions are provided on different parts of the flashlight 10 such that the present invention is not limited to the male and female arrangement described above. For example, in another embodiment, the main body 14 includes the male portion and the electrical contacts 102, while the light head 18 includes the female portion and the electrical contacts 62.

In operation of the flashlight 10, while electricity is being carried through the electrical contacts 62 and the electrical contacts 102, a user may operate the switch 54 to selectively control a state of the light source 82 (e.g., ON/OFF). In the ON state of the light source 82, a full circuit, which includes the circuit boards 26, the battery 30, the switch contacts 58, the electrical contacts 62, the light source 82, the substrate 84, and/or the electrical contacts 102, is completed and the light source 82 is powered by a PWM signal to emit a pattern or area of light.

In the OFF state of the light source 82, the full circuit described above is still completed, but no PWM signal is sent to power the light source 82. While in either the ON or OFF state, the user may selectively break the full circuit by rotating the light head 18 relative the main body 14 a sufficient amount to disconnect the electrical contacts 62 from the electrical contacts 102. The user may further move the light head 18 axially relative the main body 14 to completely remove the light head 18 from the main body 14.

In order to re-complete the full circuit, the user may axially insert the electrical contacts 102 into the bayonet channels 142, 146 and rotate the light head 18 relative the main body 14 to connect the electrical contacts 102 with the electrical contacts 62. In this manner, the user effectively re-connects the light head 18 to the main body 14.

The embodiment(s) described above and illustrated in the figures are presented by way of example only and are not intended as a limitation upon the concepts and principles of the present disclosure. As such, it will be appreciated that variations and modifications to the elements and their configuration and/or arrangement exist within the spirit and scope of one or more independent aspects as described.

What is claimed is:

1. A flashlight comprising:

a main body;

a power source supported within the main body; and a light head removably coupled to the main body, the light head including a light source selectively powered by the power source, a lens, and a sliding focus mechanism that is linearly slidable along an axial direction to adjust a distance between the light source and the lens, wherein the light source is electrically connected with the power source while the light head is coupled to the main body, wherein the light head is removably coupled to the main body by a bayonet-style connection, and wherein a first connection portion of the bayonet-style connection is formed on the light head and a second connection portion complementary to the first connection portion is formed on the main body, and wherein the first and second connection portions each include electrical contacts configured to electrically connect the power source and the light source.

2. The flashlight of claim 1, wherein a portion of the light head other than the first connection portion selectively bears against the power source while the light head is coupled to the main body, and wherein the power source is accessible in the main body while the light head is separated from the main body.

3. The flashlight of claim 1, wherein the light head further includes a base including a light source support, and a focusing head portion moveable relative the base via the sliding focus mechanism, the sliding focus mechanism having stops limiting axial relative movement between the base and the focusing head portion.

4. The flashlight of claim 3, wherein the light head further includes a gasket positioned between the focusing head and the base to resist movement therebetween.

5. The flashlight of claim 3, wherein the focusing head portion includes a lens mount and a lens retainer threadably coupled to the focusing head portion on opposing ends of the lens such that the lens is retained within the focusing head portion between the lens mount and the lens retainer.

6. The flashlight of claim 5, wherein the base further includes a substrate, an insert, the insert and the substrate each threadably fastened within the base, one or more of the substrate and the insert being electrically conductive, and a reflector surrounding the light source.

7. The flashlight of claim 6, wherein the lens, the lens mount, and the lens retainer are axially moveable via the sliding mechanism relative the substrate, the insert, the light source, and the reflector between the stops to selectively generate a relatively wide or narrow light pattern, the lens surrounding the reflector and the light source to generate the relatively wide light pattern.

8. A flashlight comprising:

a main body including a main body connection portion and an end cap;

a power source supported within the main body between the end cap and the main body connection portion;

a first electrical contact supported in the main body connection portion and electrically connected to the power source;

a light head including a light source and a light head connection portion; and a second electrical contact supported in the light head connection portion and electrically connected to the light source, the light head being rotatable and axially slidable along an axial direction relative to the main body to selectively remove the light head from the main body and electrically disconnect the power source from the light source.

9. The flashlight of claim 8, wherein the main body connection portion includes a bayonet channel, and wherein the first electrical contact is positioned within the bayonet channel.

10. The flashlight of claim 9, wherein the second electrical contact is slidably received in the bayonet channel and rotatable with the light head into connection with the first electrical contact.

11. The flashlight of claim 10, wherein the bayonet channel includes a linear groove portion and a radial groove portion continuous with the linear groove portion, the linear groove portion extending axially along the axial direction and the radial groove portion extending from the linear groove portion and radially around a portion of the main body.

12. The flashlight of claim 11, wherein the first electrical contact is positioned within the radial groove portion of the bayonet channel.

13. The flashlight of claim 12, wherein the second electrical contact connects to the first electrical contact only in the radial groove portion.

14. The flashlight of claim 10, wherein the first electrical contact generates a biasing force radially outwardly, and wherein the second electrical contact is rotatable relative the first electrical contact to temporarily overcome the biasing force and snap the second electrical contact into electrical and mechanical connection with the first electrical contact.

15. A flashlight comprising:

a main body;

a power source supported within the main body;

a first electrical contact supported by the main body and electrically connected to the power source;

a head removably coupled to the main body, the head including a light source, a lens, and a sliding focus mechanism axially moveable to adjust a distance between the light source and the lens;

a second electrical contact supported by the head and electrically connected to the light source;

a main body bayonet portion supporting the first electrical contact; and a head bayonet portion supporting the second electrical contact and engaged with the main body bayonet portion to electrically connect the first electrical contact with the second electrical contact.

16. The flashlight of claim 15, wherein the main body bayonet portion includes a bayonet channel, and wherein the first electrical contact is positioned within the bayonet channel.

17. The flashlight of claim 16, wherein the bayonet channel is first bayonet channel positioned on a first side of the main body, and wherein the main body bayonet portion includes a second bayonet channel positioned on a second side of the main body opposite the first side.

18. The flashlight of claim 17, further comprising a third electrical contact supported by the main body and electrically connected to the power source; and a fourth electrical contact supported by the head and electrically connected to the light source, wherein the second bayonet channel includes the third electrical contact, and wherein the head is rotatable relative the main body to electrically connect the first electrical contact with the second electrical contact in the first bayonet channel and to electrically connect the third electrical contact with the fourth electrical contact in the second bayonet channel.

19. A flashlight comprising:

a main body;

a power source supported within the main body; and a light head removably coupled to the main body, the light head including a light source selectively powered by the power source, a lens, and a sliding focus mechanism that is linearly slidable along an axial direction to adjust a distance between the light source and the lens, wherein the light source is electrically connected with the power source while the light head is coupled to the main body, wherein the light head further includes a base including a light source support, and a focusing head portion moveable relative the base via the sliding focus mechanism, the sliding focus mechanism having stops limiting axial relative movement between the base and the focusing head portion, and wherein the focusing head portion includes a lens mount and a lens retainer threadably coupled to the focusing head portion on opposing ends of the lens such that the lens is retained within the focusing head portion between the lens mount and the lens retainer.

20. The flashlight of claim 19, wherein the base further includes a substrate, an insert, the insert and the substrate each threadably fastened within the base, one or more of the substrate and the insert being electrically conductive, and a reflector surrounding the light source.

21. The flashlight of claim 20, wherein the lens, the lens mount, and the lens retainer are axially moveable via the sliding mechanism relative the substrate, the insert, the light source, and the reflector between the stops to selectively generate a relatively wide or narrow light pattern, the lens surrounding the reflector and the light source to generate the relatively wide light pattern.

* * * * *